US006283334B1

(12) United States Patent
Mahaffey et al.

(10) Patent No.: US 6,283,334 B1
(45) Date of Patent: Sep. 4, 2001

(54) PERSONAL DISPENSING SYSTEM

(75) Inventors: Cleary E. Mahaffey, Suwanee; Richard P. Lewis, Marietta, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/386,056

(22) Filed: Aug. 30, 1999

(51) Int. Cl.[7] ..... B67D 5/64

(52) U.S. Cl. ..... 222/175; 222/181.1; 222/212; 222/494; 224/148.7

(58) Field of Search ..... 222/175, 181.1, 222/212, 213, 494, 148.2, 148.7, 546

(56) References Cited

U.S. PATENT DOCUMENTS

| | | | | |
|---|---|---|---|---|
| D. 291,168 | | 8/1987 | Cranford . | |
| 899,290 | | 9/1908 | Bricker . | |
| 1,445,642 | * | 2/1923 | O'Neill | 224/148.7 |
| 1,611,275 | | 12/1926 | Lewis . | |
| 1,646,562 | | 10/1927 | Snow . | |
| 1,825,897 | * | 10/1931 | Brooke | 224/148.7 |
| 2,289,701 | | 7/1942 | Engel et al. . | |
| 2,532,244 | | 11/1950 | Pasmore . | |
| 2,550,554 | | 4/1951 | Griffin . | |
| 2,729,913 | | 1/1956 | Holwerda . | |
| 3,121,508 | | 2/1964 | Kase . | |
| 3,160,304 | | 12/1964 | Peacock . | |
| 3,768,684 | | 10/1973 | Buchtel . | |
| 4,228,928 | | 10/1980 | Hocker et al. . | |
| 4,363,432 | | 12/1982 | Warthen . | |
| 4,463,859 | | 8/1984 | Greene . | |
| 4,606,523 | | 8/1986 | Statz et al. . | |
| 4,634,089 | | 1/1987 | Wright et al. . | |
| 4,723,801 | | 2/1988 | Musumeci et al. . | |
| 4,747,519 | | 5/1988 | Green et al. . | |
| 4,848,625 | | 7/1989 | Lucia . | |
| 4,955,518 | | 9/1990 | Parsons et al. . | |
| 4,955,572 | | 9/1990 | Simmons . | |
| 5,148,949 | | 9/1992 | Luca . | |
| 5,183,169 | | 2/1993 | Gryzych . | |
| 5,213,236 | | 5/1993 | Brown et al. . | |
| 5,232,137 | | 8/1993 | Devine . | |
| 5,335,954 | | 8/1994 | Holub et al. . | |
| 5,477,999 | | 12/1995 | Blankenship, Jr. . | |
| 5,482,172 | | 1/1996 | Braddock . | |
| 5,499,748 | * | 3/1996 | Iaia et al. | 222/213 |
| 5,749,490 | | 5/1998 | Keicher . | |
| 5,819,997 | | 10/1998 | Mathis et al. . | |
| 5,971,232 | * | 10/1999 | Rohr et al. | 222/213 |
| 6,045,017 | * | 4/2000 | Connell | 224/148.7 |
| 6,062,435 | * | 5/2000 | Hess, III | 222/175 |

FOREIGN PATENT DOCUMENTS

WO 94/11260 5/1994 (WO) .

OTHER PUBLICATIONS

European Patent Office Search Report Jan, 24, 2001.

* cited by examiner

*Primary Examiner*—Joseph A. Kaufman
(74) *Attorney, Agent, or Firm*—Dority & Manning

(57) ABSTRACT

A personal dispensing system allows various cleansing or sanitizing products to be carried on the body of a user. Often, the product to be dispensed will be a viscous liquid, such as soap, waterless hand cleaner, waterless hand sanitizer or skin lotion. A dispenser made according to the invention includes a product container having a mounting element, such as a mounting clip, located thereon. In many cases, the mounting element will be oriented such that the product container will be inverted when worn on the body of a user. In addition, the mounting element may be removable from the product container so that a new product container can be substituted when the contents of a prior product container are depleted. According to another advantageous aspect of the invention, multiple product containers of different types may be used with a common mounting element. Various interlocking arrangements are contemplated to effect the removable securement of the mounting element to the product container.

13 Claims, 6 Drawing Sheets

PERSONAL DISPENSING SYSTEM

BACKGROUND OF THE INVENTION

The present invention relates generally to dispensers which contain and dispense a predetermined viscous liquid. More particularly, the invention relates to an improved dispenser which is adapted for wear on the body of an individual user.

Many professions and occupations require the use of hand cleaners or other skin care products on a frequent basis. For example, health care providers such as nurses must sanitize their hands after each patient. Often, the nurse must return to the nurses' station to perform this hand sanitizing, which can cause additional time pressure in an already busy schedule.

Similarly, the hands of an employee working in a printing, manufacturing or other such industry can become soiled at the work station. Frequent trips to the washroom for the purpose of hand cleaning are inefficient and unproductive. In other situations, such as in the case of a utility or similar outside worker, there may be no washroom facility available if the worker's hands become soiled.

SUMMARY OF THE INVENTION

The present invention recognizes and addresses the foregoing disadvantages, and others, of the prior art. Accordingly, it is an object of the present invention to provide a novel product dispenser that is wearable by a worker.

It is a further object of the present invention to provide a wearable product dispenser that allows viscous liquid to be dispensed without removing the dispenser from a user's body.

It is a further object of the present invention to provide a wearable product dispenser that includes a removable mounting element for facilitating substitution of one product container for another.

It is a still further object of the present invention to provide a wearable dispenser system in which multiple types of product dispensers can be used with a common mounting element.

Some of these objects are achieved by a viscous liquid dispenser comprising a product container having therein a quantity of a predetermined viscous liquid. A container opening is located at one end of the product container. The product container further includes a flexible sidewall, depression of which causes the viscous liquid to be forced through the container opening. A mounting element is located on the product container, and is oriented such that the product container will be inverted when worn on a user's body.

In many embodiments, the mounting element will comprise a mounting clip suitable for wear on the body. Such a mounting clip may be configured as a separate element having a base portion fixedly attached to the product container. Alternatively, the clip may be made integral with the product container in certain embodiments.

Where the mounting clip is a separate element, the product container may advantageously define a configured recess into which the base portion of the mounting clip is received. In some cases, the mounting clip may include a clip portion pivotally connected to the base portion. Alternatively, the mounting clip may comprise a clip portion integrally extending from the base portion.

In some exemplary embodiments, the mounting clip may be removably attached to the product container using any one of various interlocking arrangements. For example, an interlocking head-in-slot arrangement can be provided for this purpose. Such an arrangement can include at least one dovetail head received in a corresponding mortise slot. Alternatively, the mounting clip may be removably attached to the product container using an interlocking tongue-in-groove arrangement.

Other objects of the present invention are achieved by a wearable dispenser comprising a mounting clip having a base portion and a clip portion. The dispenser includes a product container having a product to be dispensed located therein. An interlocking arrangement is also provided, having first and second interlocking portions on the base portion of the mounting clip and on the product container, respectively. As a result, the mounting clip can be removably attached to the product container.

In some presently preferred embodiments, the product container contains a predetermined viscous liquid and is removably attached to the mounting clip in an inverted orientation. Depending on the desired usage, the viscous liquid may be selected from a group consisting of soap, waterless hand cleaner, waterless hand sanitizer or skin lotion. In other embodiments, the product container may be removably attached to the mounting clip in an upright orientation. The upright product container may contain a plurality of fabric wipes.

The interlocking arrangement may comprise a head-in-slot arrangement. For example, a first interlocking portion of the head-in-slot arrangement may include a plurality of mortise slots defined in the base portion of the mounting clip. The second interlocking portion may comprise a plurality of dovetail heads received in respective mortise slots. Often, head-slot combinations of the head-in-slot arrangement may be differently sized such that the mounting clip can be attached to the product container in only one orientation.

Additional objects of the present invention are achieved by a wearable dispenser system comprising a first product container having therein a predetermined viscous liquid. A second product container is also provided, having a plurality of fabric wipes therein. The first product container has a first pair of differently-sized attachment heads located thereon, with the second product container having a second pair of differently-sized attachment heads located thereon. The dispenser system includes a wearable mounting element having a base portion defining a pair of differently-sized slots for receipt of respective attachment heads therein. The first pair of differently-sized attachment heads are arranged such that the first product container will be attached to the mounting element in an inverted orientation. The second pair of differently-sized attachment heads are arranged such that the second product container will be attached to the mounting element in an upright orientation.

Still further objects of the present invention are achieved by a product container comprising a container body containing therein a product to be dispensed. The container body, having a flattened cross section, includes a pair of differently-sized attachment heads located on a side surface thereof. Each of the attachment heads is configured as a dovetail head for receipt in a complementary mortise slot.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
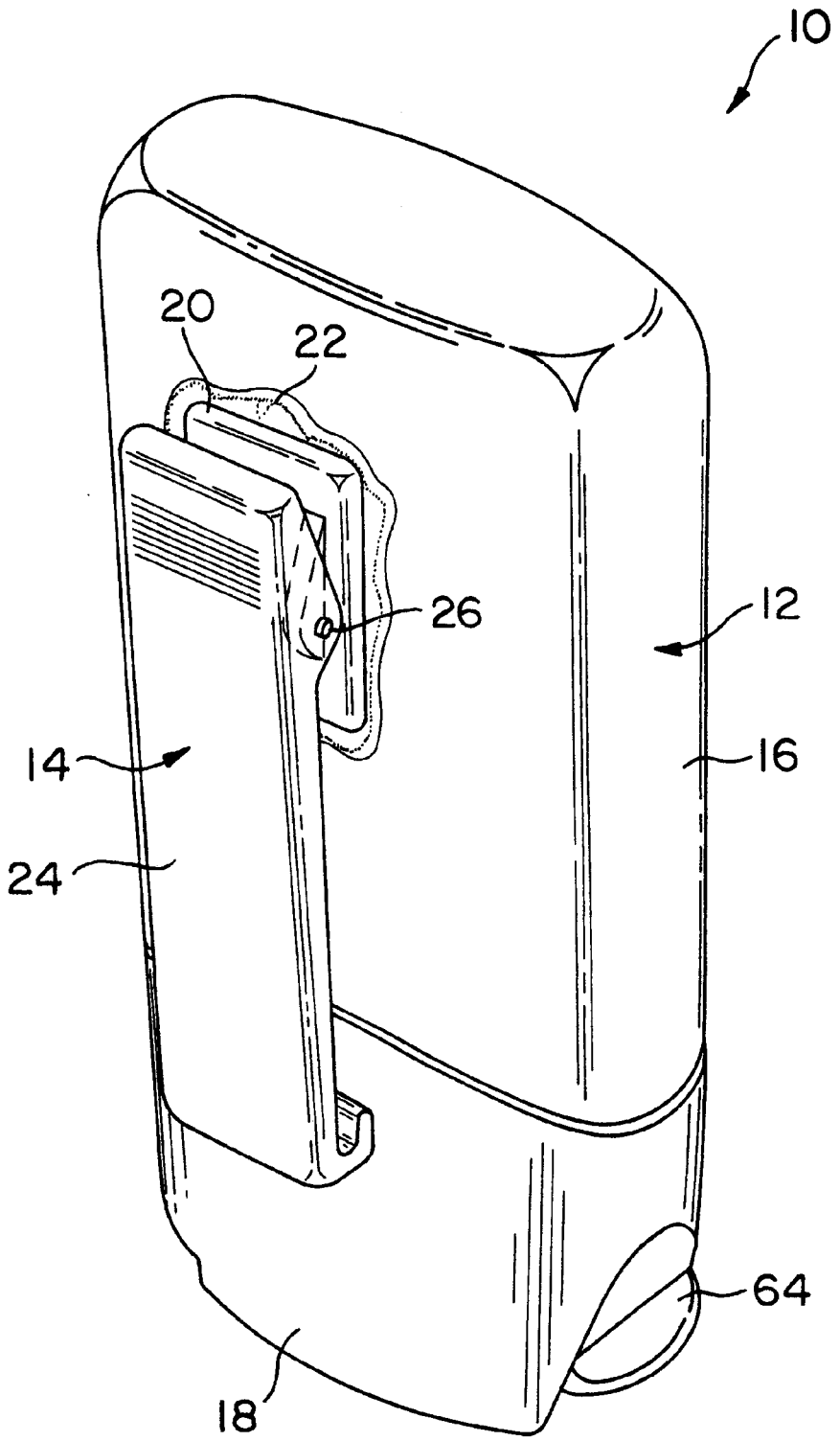
FIG. 1 is a perspective view showing one embodiment of a wearable dispenser constructed in accordance with the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Referring now to FIG. 1, a wearable dispenser 10 includes a product container 12 having a mounting element attached thereto. In this case, the mounting element is configured as a mounting clip 14. The body of product container 12 includes a main container portion 16 and a cap portion 18. A quantity of a predetermined viscous liquid is located inside of main container portion 16 to be dispensed by a user when desired. Depending on the user's requirements, the viscous liquid may be one of several different types of cleansing or skin care products. For example, the viscous liquid may be soap, waterless hand cleaner, waterless hand sanitizer, skin lotion, or the like.

Mounting clip 14 permits product dispenser 12 to be worn on the user's body, such as on the user's belt, pocket or waistband. In this case, mounting clip 14 is oriented so that product container 12 will be inverted when the dispenser is worn. In other words, the "top end" of product container 12, defined by cap portion 18, will be directed toward the floor when dispenser 10 is worn. As a result, the user will typically be able to dispense the viscous liquid into a cupped hand without first removing the product dispenser from the user's body.

In other applications, it may be desirable to orient the product container in an upright configuration. Irrespective of the orientation, however, product container 12 is preferably configured having a flattened cross section so that it will not excessively protrude from the side of the user's body. For example, product dispenser 12 has a generally oval cross section in the illustrated embodiment.

As shown, mounting clip 14 includes a base portion 20 fixedly attached to the side of product container 12. In this case, base portion 20 is attached using a suitable adhesive compound 22. It should be distinctly understood, however, that other appropriate means of attaching base portion 20, such as sonic welding, may also be utilized for this purpose. Mounting clip 14 further includes a rigid clip portion 24 connected to base portion 20 such that it will pivot about pivot location 26. A suitable spring may be provided to urge clip portion 24 into a normally closed position.

Figure 2:
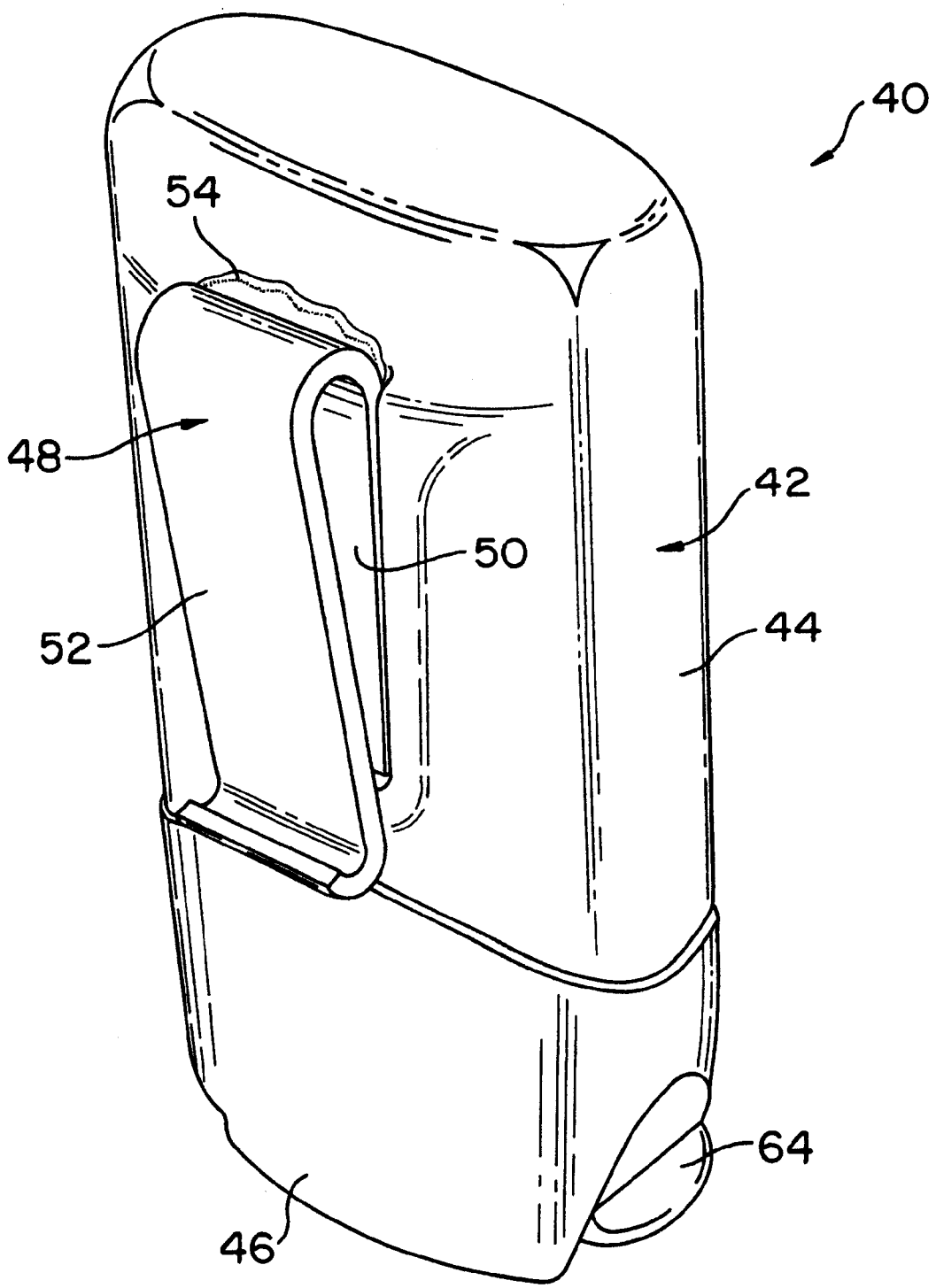
FIG. 2 is a perspective view showing an alternative embodiment of a wearable dispenser constructed in accordance with the present invention.

FIG. 2 illustrates a dispenser 40 that is similar in many respects to dispenser 10, but which has an alternative mounting clip. Dispenser 40 includes a product container 42 having a main container portion 44 and a cap portion 46. A predetermined viscous liquid, located inside of main container portion 44, is dispensed through a container opening at cap portion 46.

Mounting clip 48 has a base portion 50 integrally folding into an opposed clip portion 52. Base portion 50 is suitably attached to the outside of main container portion 44, such as by an adhesive compound 54. As shown, a configured recess may be defined in the outer surface of main container portion 44 for receipt of base portion 50 therein. Preferably, mounting clip 48 will be manufactured from a suitable plastic material having sufficient flexibility to permit it to be easily slipped into position on the user's clothing, while remaining securely in place once it has been so positioned.

Figure 3B:
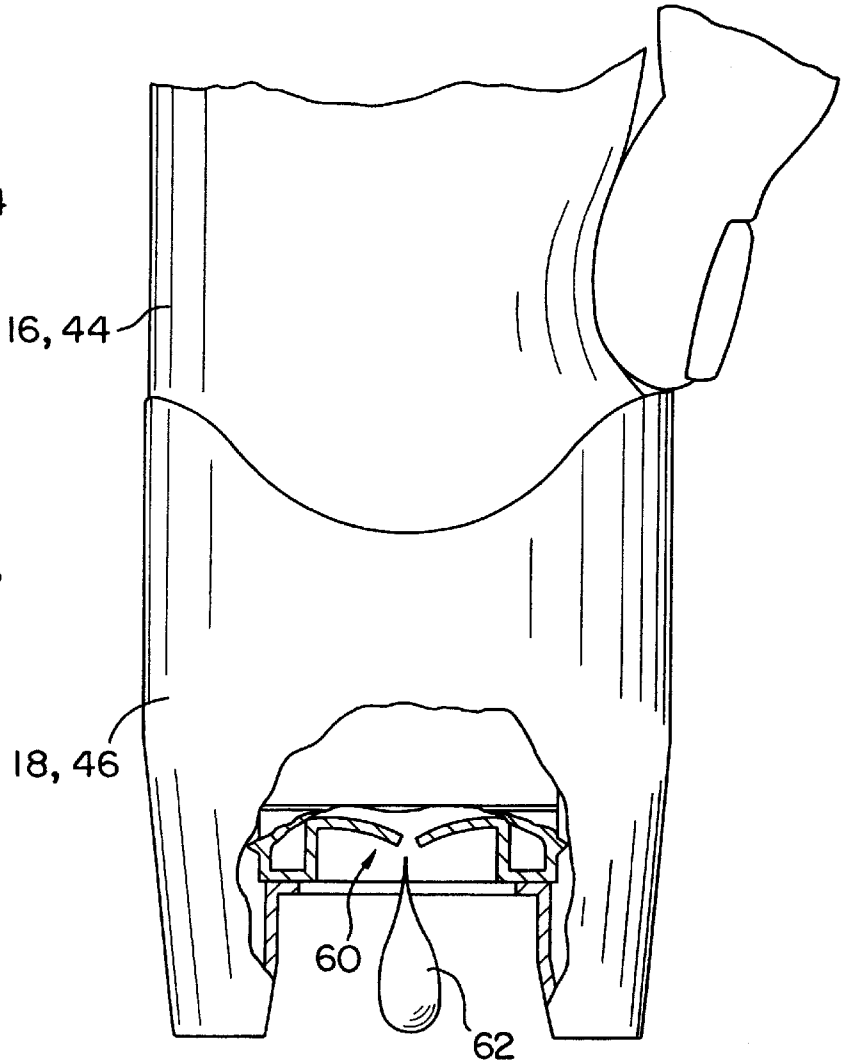
FIGS. 3A and 3B are enlarged fragmentary views, partially in section, showing the structure and operation of a normally-closed valve located at the container opening in the dispensers of FIGS. 1 and 2.
Figure 3A:
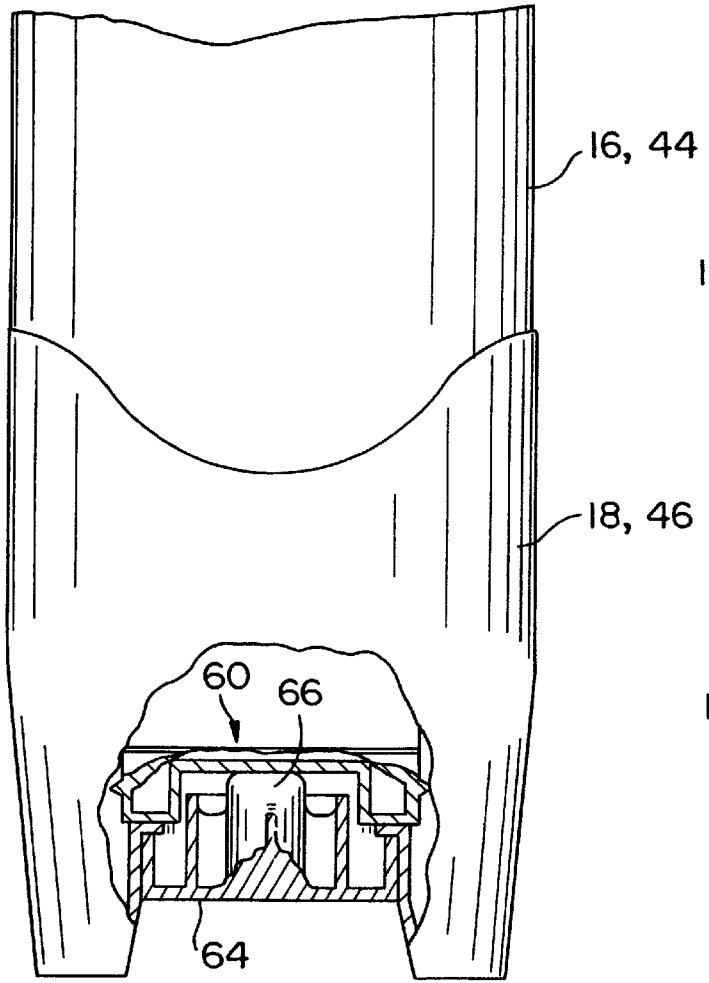

Referring now to FIGS. 3A and 3B, dispensers 10 and 40 are both equipped with an identical valve mechanism which eliminates the need to repeatedly open and close the container's cap each time that a user decides to dispense some of the viscous liquid. Valve 60 remains normally closed to retain the viscous liquid inside of the product container even though the cap is otherwise opened. When the flexible sidewall of main container portion 16, 44 is depressed by a user, a "shot" 62 of the viscous liquid is dispensed (as shown in FIG. 3B).

While various types of check valves and the like may be used, valve 60 may be formed as a simple diaphragm valve directly at the container opening. The diaphragm valve operates similarly to a heart valve, opening when fluid is pushed through it from behind, then resuming its normally closed condition.

The dispenser is fully closed when a lever member 64, pivotally carried by cap portion 18, 46, is moved into a closed position. In this position, as shown in FIG. 3A, a stopper element 66 will engage valve 60. Stopper element 66 will thus block the container opening, and prevent the viscous liquid from being dispensed.

In some cases, it may be advantageous to utilize a mounting element that is easily removable from the product container. For example, it may be desirable to transfer a new product container to the mounting element when a prior product container is empty. Similarly, a common mounting element may be used with multiple product containers, each of which contains a different type of consumable product.

Figure 4:
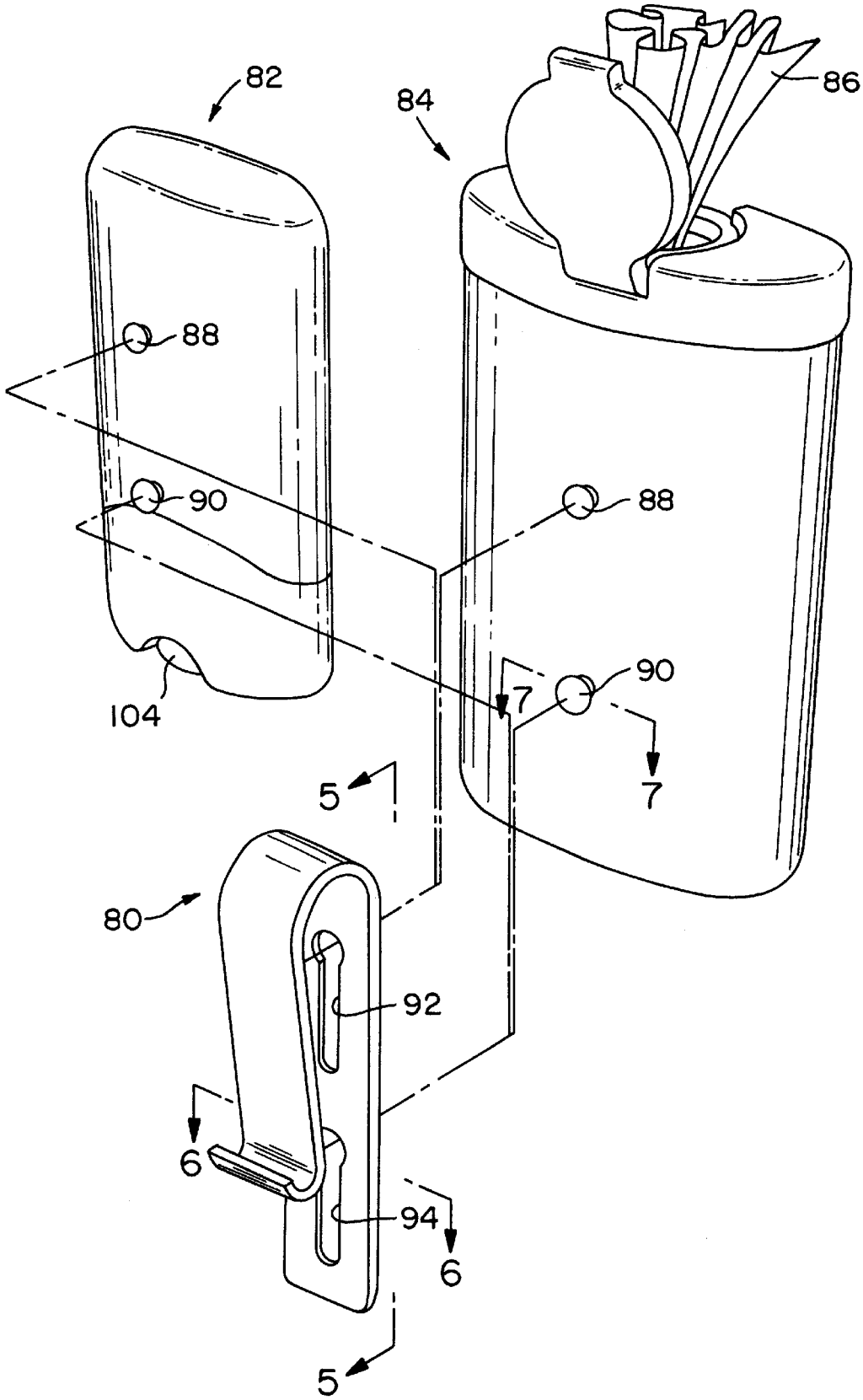
FIG. 4 illustrates a dispenser system utilizing product dispensers of different types in conjunction with a common wearable clip.

Toward this end, FIG. 4 illustrates a dispenser system in which a common mounting element is used with multiple product containers. While it is contemplated that various types of mounting elements, such as belt-loop structures may be used, the illustrated embodiment utilizes a mounting clip 80. In this example, a first product container 82 is used to dispense a predetermined viscous liquid. A second product container 84, on the other hand, dispenses fabric wipes 86, which are preferably saturated with a cleansing or sanitizing solvent. In many cases, the user may substitute one product container for the other while mounting clip 80 remains in position on the user's body.

A suitable interlocking arrangement is provided to allow mounting clip 80 to be easily attached to the desired product container. In this case, each of the product containers includes a pair of attachment heads 88, 90 located on its outer surface. Attachment heads 88, 90 are received in respective slots 92, 94 defined through the base portion of mounting clip 80. Head 90 and its corresponding slot 94 are larger than head 88 and its corresponding slot 92 in order to ensure that the product container will be attached only in the correct orientation. In the illustrated embodiment, product container 82 can be attached only in an inverted configuration, whereas product container 84 can be attached only in an upright orientation.

Figure 5:
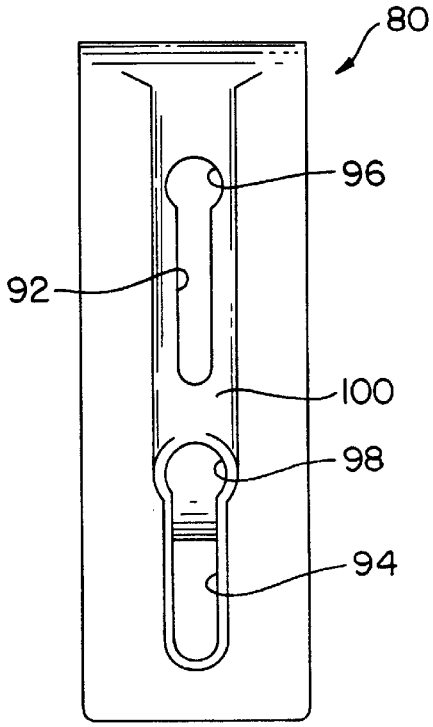
FIG. 5 is an elevational view taken along line 5—5 of FIG. 4.
Figure 6:
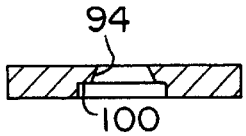
FIG. 6 is a cross-sectional view taken along line 6—6 of FIG. 4.
Figure 7:
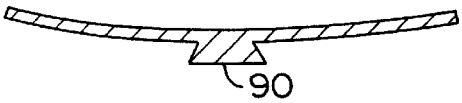
FIG. 7 is a cross-sectional view taken along line 7—7 of FIG. 4.

Referring now also to FIGS. 5–7, attachment heads 88, 90 are preferably configured as dovetail heads tapering out from the outer surface of the product container. Each of slots 92, 94 may be thought of as a mortise having a taper generally complementary to that of the corresponding dovetail head.

To attach the product container, attachment heads 88, 90 are first inserted into a respective receiving hole 96, 98. As indicated at 100, a recessed relief may be defined in the outer surface of mounting clip 80 to guide the attachment heads into the receiving holes. The heads are then slid along the corresponding slot to form a relatively secure, but removable attachment between the product container and mounting clip 80.

Figure 8:
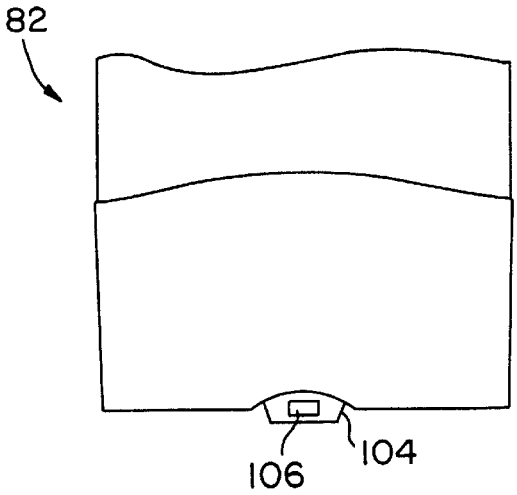
FIG. 8 is an enlarged fragmentary view of the viscous-liquid dispenser of FIG. 4, illustrating the container opening thereof.

FIG. 8 illustrates in detail the particular closure arrangement used in product container 82. As shown, a pivotal closure 104 reveals the container opening 106 when moved into its open position. The viscous liquid is dispensed when the user moves closure 104 to its open position, and depresses the flexible sidewall of product container 82.

Figure 10:
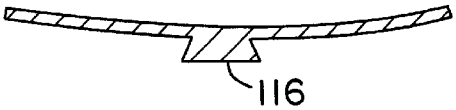
FIG. 10 is a cross-sectional view taken along line 10—10 of FIG. 9.
Figure 11:
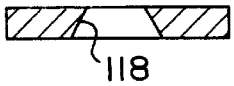
FIG. 11 is a cross-sectional view taken along line 11—11 of FIG. 9.
Figure 9:
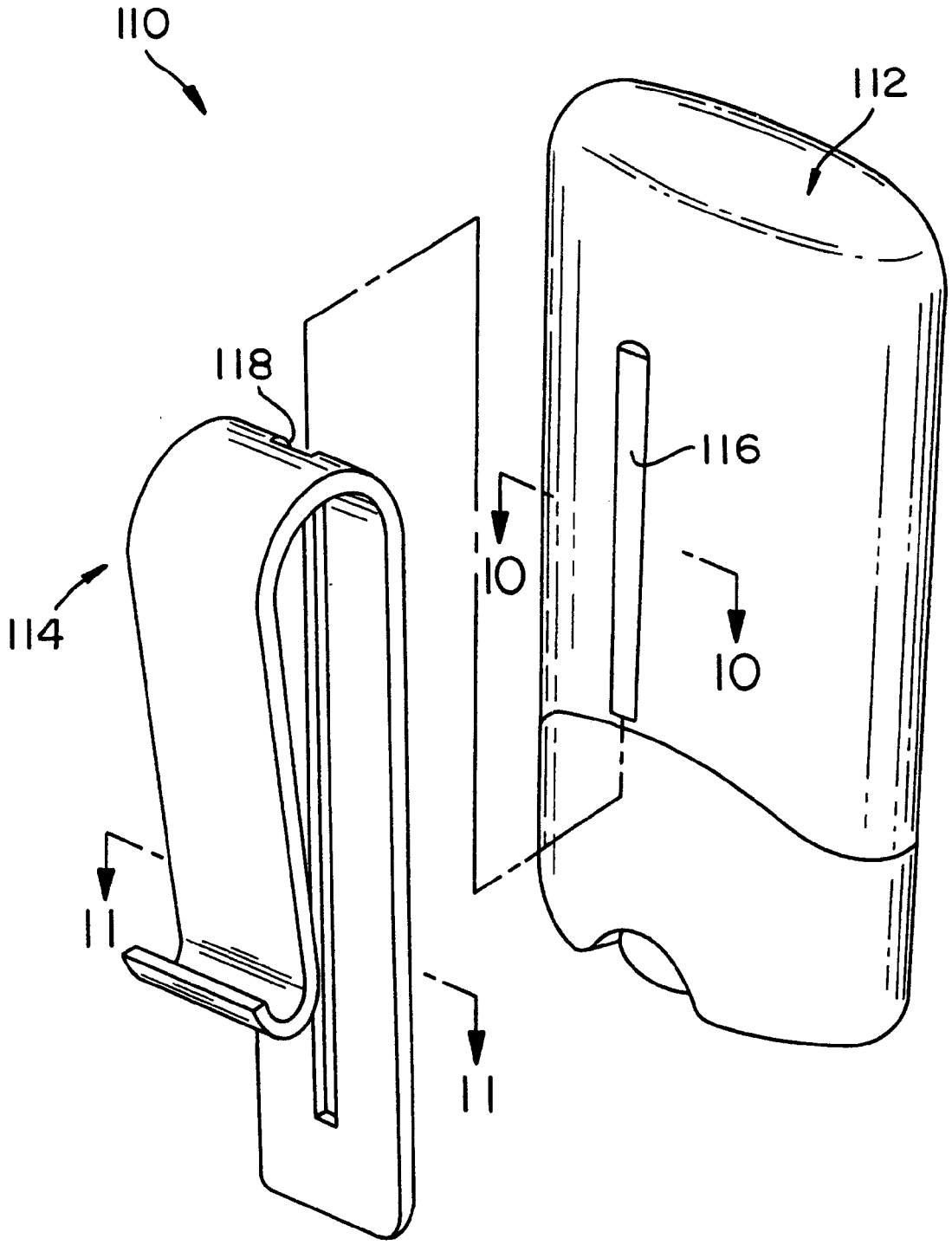
FIG. 9 is a perspective view of a wearable dispenser constructed in accordance with the present invention, showing an alternative interlocking arrangement for attaching the removable mounting clip.

While a head-in-slot arrangement has been shown in the preceding embodiment, the invention contemplates the use of any suitable arrangement for effecting attachment of the product container to the mounting element. For example, FIGS. 9 through 11 illustrate a dispenser 110 utilizing a tongue-in-groove arrangement for attaching product container 112 to a removable mounting clip 114. In this case, the tongue element is formed as an elongate dovetail tongue 116 located on the outer surface of product container 112. The groove, defined in mounting clip 114, is configured as a mortise groove 118. The complementary tapers of the dovetail and mortise create a relatively secure engagement that can be easily disconnected when desired.

It can thus be seen that the present invention provides various product dispenser arrangements that are adapted for wear on the body. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A viscous liquid dispenser comprising:

a product container having therein a quantity of a predetermined viscous liquid, said product container having a container opening located at one end thereof;

said product container further including a flexible sidewall such that depression of said flexible sidewall will cause said viscous liquid to be forced through said container opening;

a mounting element located on said product container, said mounting element being oriented such that said product container will be inverted when worn on a user's body;

wherein said mounting element comprises a mounting clip and wherein said mounting clip includes a base portion fixedly attached to said product container; and wherein said product container defines a configured recess into which said base portion of said mounting clip is received.

2. A dispenser as set forth in claim 1, wherein said mounting clip includes a clip portion pivotally connected to said base portion.

3. A dispenser as set forth in claim 1, wherein said mounting clip comprises a clip portion integrally extending from said base portion.

4. A viscous liquid dispenser comprising:

a product container having therein a quantity of a predetermined viscous liquid, said product container having a container opening located at one end thereof;

said product container further including a flexible sidewall such that depression of said flexible sidewall will cause said viscous liquid to be forced through said container opening;

a mounting element located on said product container, said mounting element being oriented such that said product container will be inverted when worn on a user's body;

wherein said mounting element comprises a mounting clip and wherein said mounting clip is removably attached to said product container and wherein said mounting clip is removably attached to said product container using an interlocking head-in-slot arrangement; and wherein said head-in-slot arrangement includes a first head-in-slot combination and a second head-slot combination.

5. A dispenser as set forth in claim 4, wherein said first head-slot combination and said second head-slot combination are differently sized such that said mounting clip can be attached to said product container in only one orientation.

6. A wearable dispenser comprising:

a mounting clip having a base portion and a clip portion;

a product container having therein a product to be dispensed;

an interlocking arrangement having first and second interlocking portions on said base portion of said mounting clip and on said product container, respectively, such that said mounting clip can be removably attached to said product container;

wherein said interlocking arrangement comprises a head-in-slot arrangement; and wherein first interlocking portion of said head-in-slot arrangement includes a plurality of mortise slots defined in said base portion of said mounting clip, and said second interlocking portion comprises a plurality of dovetail heads received in respective of said mortise slots.

7. A wearable dispenser as set forth in claim 6, wherein said product container is removably attached to said mounting clip in an inverted orientation, said dispenser containing a predetermined viscous liquid.

8. A wearable dispenser as set forth in claim 7, wherein said viscous liquid is selected from a group consisting of soap, waterless hand cleaner, waterless hand sanitizer and skin lotion.

9. A wearable dispenser as set forth in claim 6, wherein said product container is removably attached to said mounting clip in an upright orientation.

10. A wearable dispenser as set forth in claim 9, wherein said product container contains a plurality of fabric wipes.

11. A wearable dispenser as set forth in claim 6, wherein head-slot combinations of said head-in-slot arrangement are differently sized such that said mounting clip can be attached to said product container in only one orientation.

12. A wearable dispenser system comprising:

a first product container having therein a predetermined viscous liquid, said first product container having a first pair of differently-sized attachment heads located thereon;

a second product container having therein a plurality of fabric wipes, said second product container having a second pair of differently-sized attachment heads located thereon;

a wearable mounting element having a base portion defining a pair of differently-sized slots for receipt of respective attachment heads therein; and said first pair of differently-sized attachment heads being arranged such that said first product container will be attached to said mounting element in an inverted orientation and said second pair of differently-sized attachment heads being arranged such that said second product container will be attached to said mounting element in an upright orientation.

13. A product container comprising:

a container body having a flattened cross section and containing therein a product to be dispensed; and a pair of differently-sized attachment heads located on a side surface of said container body, each of said attachment heads being configured as dovetail heads for receipt in a complementary mortise slot.

* * * * *